US005152968A

United States Patent [19]

Foti et al.

[11] Patent Number: 5,152,968

[45] Date of Patent: Oct. 6, 1992

[54] SINGLE PASS VAPOR GENERATION CONTAINER STERILIZATION SYSTEM

[75] Inventors: Robert C. Foti, Plymouth; Carl W. Blitz, Fenton, both of Mich.

[73] Assignee: Elopak Systems A.G., Glattbrugg, Switzerland

[21] Appl. No.: 628,617

[22] Filed: Dec. 17, 1990

[51] Int. Cl.[5] ..... A61L 2/20; B65B 55/10

[52] U.S. Cl. ..... 422/304; 53/425; 53/111 RC; 99/483; 141/91; 422/31; 422/298; 422/302

[58] Field of Search ..... 422/31, 298, 304, 302; 53/425, 111 RC; 99/483; 141/91

[56] References Cited

U.S. PATENT DOCUMENTS 4,742,667 5/1988 Müller et al. ..... 422/304 X 4,992,247 2/1991 Foti ..... 422/304

*Primary Examiner*—Jill A. Johnston

*Attorney, Agent, or Firm*—Reising, Ethington, Barnard, Perry & Milton

[57] ABSTRACT

A container sterilization system adaptable to a forming, filling and sealing machine used to process containers for liquids or spoonable food products. The system is a single pass vapor generator including ductwork interconnecting a suitable blower for directing a flow through sterilization stations; a duct heater; a vapor generation stack; a suitable vapor delivery inlet manifold and an associated exhaust manifold; and a drying air inlet manifold and an associated exhaust manifold, with containers being conveyed laterally intermediate the inlet manifolds and the exhaust manifolds. The directed flow is a mixture of air, vaporized hydrogen peroxide, and vaporized water.

11 Claims, 1 Drawing Sheet

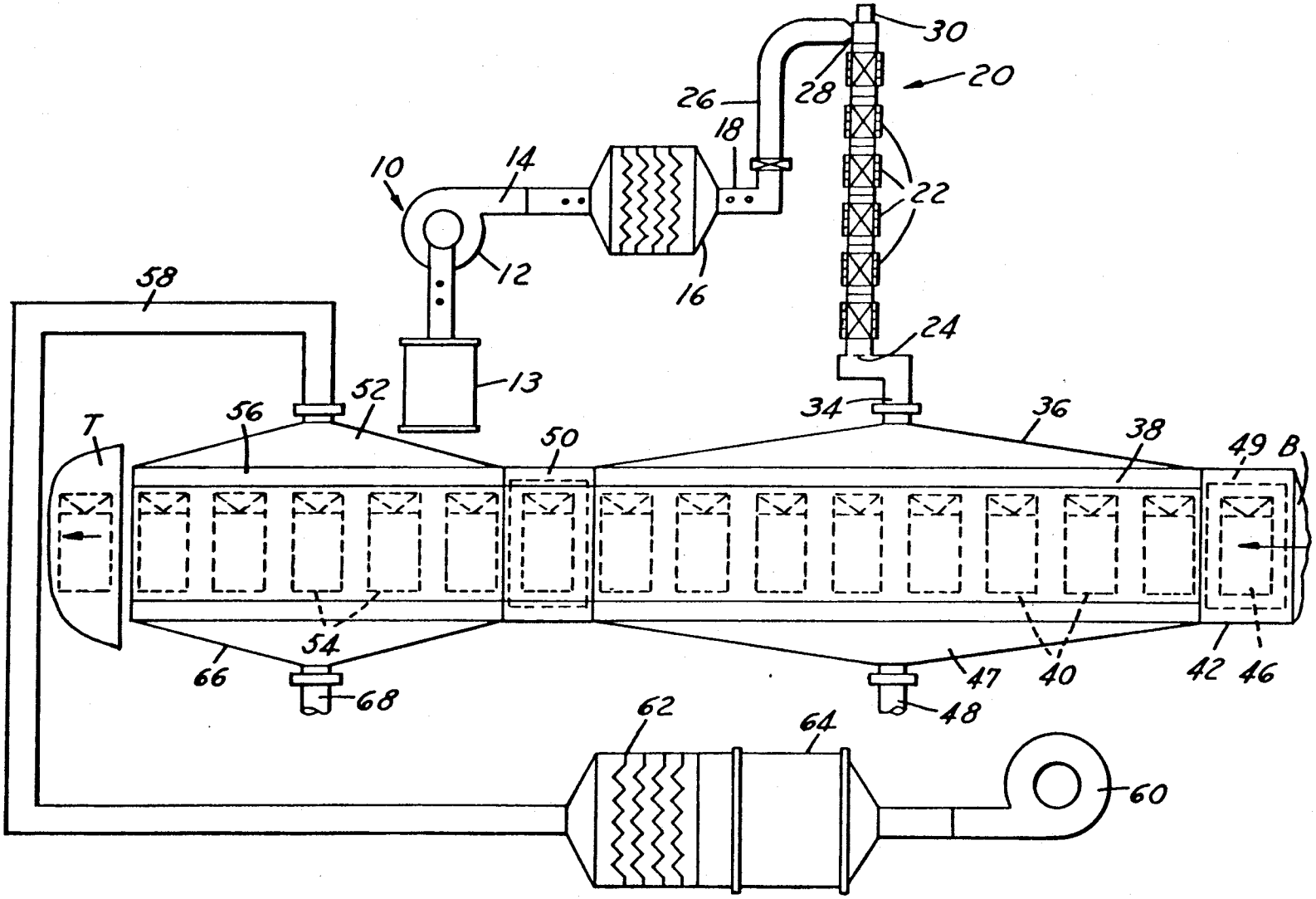
10
12
13
14
16
18
20
22
24
26
28
30
34
36
38
40
42
46
47
48
49
B
50
52
54
56
58
60
62
64
66
68
T

SINGLE PASS VAPOR GENERATION CONTAINER STERILIZATION SYSTEM

TECHNICAL FIELD

This invention relates generally to systems for sterilizing containers such as paperboard cartons for carrying non-carbonated or "still" liquids, such as juices, and more particularly, to such systems which are single pass vapor generation systems which may be operative in conjunction with existing forming, filling and sealing machines.

BACKGROUND ART

Forming, sterilizing, filling and sealing machines have incorporated various techniques heretofore to sterilize paperboard cartons for carrying non-carbonated or "still" liquids, such as juices. One such machine is shown and described in U.S. Pat. No. 3,566,575, wherein a hydrogen peroxide solution is supplied via an integrally mounted fogging nozzle into the open tops of cartons being fed through the machine, and heated therein to remove the fog from the cartons just prior to being filled with the designated liquid.

Another forming, filling and sealing machine incorporating a sterilization section intermediate the bottom forming and sealing section and the filling and top forming and sealing section is shown and described in U.S. Pat. No. 4,566,251, wherein the sterilization section has a separate conveyor for carrying the cartons through the latter section, and subjecting them to a sterilant vapor at a temperature substantially higher than that of the cartons, causing the vapor to condense on all surfaces of the carton, and then turned upside down by the conveyor to allow any condensate to drain therefrom while being dried prior to being lowered in an upright position.

A closed loop vapor recirculation system for use with a container filling machine through which the containers are conveyed, is shown and described in Ser. No. 350,160, now U.S. Pat. No. 4,992,247.

DISCLOSURE OF THE INVENTION

A general object of the present invention is to provide an improved single pass vapor generation system which may be adapted to a conventional carton forming, filling and sealing machine wherein a predetermined number of indexing stations, say, fourteen stations, are available between the bottom forming/sealing section and the filling/top forming/sealing section for cooperation with the sterilization system.

Another object of the invention is to provide a single pass vapor generation sterilization system including a predetermined solution of hydrogen peroxide processed through a cooperating duct heater, heat exchanger, inlet and exhaust manifolds, and a vapor generation stack, in conjunction with a longitudinal chamber extending intermediate the inlet and exhaust manifolds, through which a section of a conveyor of a forming, filling and sealing machine may traverse, conveying cartons enroute to being filled with a liquid or spoonable food product.

These and other objects and advantages will become more apparent when reference is made to the following description and accompanying drawings.

BRIEF DESCRIPTION OF THE DRAWINGS

The FIGURE is a diagrammatic layout of a single pass vapor generation sterilization system embodying the invention.

BEST MODE OF CARRYING OUT THE INVENTION

Referring now to the drawing in greater detail, there is illustrated a container sterilization system 10 of a single pass type, which may be adapted to machines used to process the forming, filling and sealing of containers for liquids and spoonable foods. The system 10 is mounted in a section of the machine intermediate the usual bottom forming and sealing section, represented as B, and the usual top forming, filling and sealing section, represented as T.

The single pass vapor generation system includes a suitable blower unit, such as a Paxton blower 12, available from Paxton Products, Inc., for initially receiving sterile air from a remote source via a suitable air filter 13, and blowing same through its outlet 14 into and through a duct heater 16, which serves to raise the temperature of the air to 200° F. as it enters a first insulated duct 18. The duct 18 leads to a vapor generation stack arrangement 20. The arrangement 20 includes a predetermined plurality of suitable heaters, represented at 22, in communication with the duct 18 intermediate an entrance 28 and an exit 24. A duct 26 communicates between the duct 18 intermediate the opening 24 and the heater 16 and an inlet air dispenser 28 at the top of the stack 20 just below a vaporizing nozzle 30, which may be an ultrasonic nozzle, into which a 35% solution of hydrogen peroxide and 65% water is fed. The resultant mixture of air, saturated with hydrogen peroxide vapor and water flows through the opening 24 into a branch duct 34 to a vapor delivery inlet manifold 36 and into a condensing chamber 38. The feature of the heaters 22 is to maintain the vaporize mixture at the desired processing temperature of, say, 200° F.

The condensing chamber 38 may cover up to any predetermined number, say eight, indexing stations 40 through which a suitable conveyor, represented at 42, conveys containers 46. A vapor delivery outlet manifold 47 below the chamber 38 communicates with an exhaust outlet 48. An inlet isolation box or, so-called, iso-box 49, serving as an air lock or curtain, is mounted at the inlet end of the condensing chamber 38.

As referenced above, containers 46 are conveyed by the conveyor 42 through the chamber 38. The containers are open-topped and preheated prior to entering the chamber 42 through the inlet iso-box 49. While indexing through the condensing chamber 38, the vaporized hydrogen peroxide and vaporized water from the ducts 18 and 34 condenses onto the inner and outer surfaces of the containers 46. The containers 46 travel through condensing stations to an exit iso-box 50. The rate of mass transfer of hydrogen peroxide solution must exceed the application rate of the solution to the indexing cartons. This is controlled by the initial pre-heat temperature of the containers. Adjustment of pre-heat temperatures determines the amount of condensate deposited on the cartons.

While being indexed by the conveyor 42 through the chamber 38, the incoming dry, pre-heated containers 46 are subjected to a three-stage process. First, as dry pre-heated cartons enter the condensing stations, the hydrogen peroxide vapor rich air flows from the manifold 36 and condenses in controlled amounts on the container. Second, as the container continues through the eight sterilizing stations, an equilibrium is achieved between the container covered with liquid hydrogen peroxide and liquid water condensate and the air saturated with hydrogen peroxide and water. The latter also serves to scrub the container. Since the container hydrogen peroxide condensate coverage is at equilibrium with the container temperature and hydrogen peroxide condensate coverage is maintained in these eight stations. The maintenance of this hydrogen peroxide condensate coverage at the process temperatures provides a unique sterilizing effect on the container.

Adjacent the iso-box 50 is a drying air inlet manifold 52 covering five conveyor indexing stations 54 in a chamber 56, serving to remove the condensate and excess vapor from the containers. The drying air is transmitted to the manifold 52 via a duct 58 leading from a blower 60. A duct heater 62 and a HEPA filter 64 are mounted in the duct 58.

An exhaust manifold 66 below the chamber 56 communicates with an exhaust duct 68.

INDUSTRIAL APPLICABILITY

It should be apparent that a single pass vapor generation system has the primary benefit of simplicity, particularly as compared to a closed loop vapor recirculation system. Specifically, no heat exchanger is required so long as the temperature of the air/hydrogen peroxide/-water mixture is controlled at the vapor generation stack bottom.

Additionally, the efficiency of iso-boxes, and the ability to maintain a large volume of hydrogen peroxide/water vapor, as would be required in a closed loop system, are no longer critical issues. The decomposition of hydrogen peroxide vapor is controlled by minimizing the vapor path length from the bottom of the vapor generation stack to the condensation manifold.

This single pass system utilizes a metered amount of dry filtered air and mixes in the correct amount of hydrogen peroxide solution to create a saturated vapor. As a result, the stack vaporization requirement is determined by the dry air inflow to the vapor generation stack. The hydrogen peroxide rich exhaust from the condensation stations can be used to provide outside heating for other locations.

It should also be apparent that each of the condensing and drying chambers could vary in size to accommodate more or less indexing stations, depending upon the size of the containers being processed therethrough.

While but one embodiment of the invention is disclosed, other modifications within the scope of the following claims are possible.

The embodiments of the invention in which an exclusive property or privilege is claimed are defined as follows:

1. A single pass vapor generation system for containers being conveyed via a conveyor, said system comprising a duct, a blower for blowing sterile air into said duct and for directing through said duct a flow of a mixture of air and solution of vaporized hydrogen peroxide and vaporized water; a duct heater mounted in the duct to raise the temperature of the sterile air to a predetermined minimum temperature; a vapor generation stack with heater means operatively connected thereto, said vapor generation stack providing a vaporized hydrogen peroxide solution into said duct; a vapor delivery inlet manifold and vapor delivery outlet manifold, a chamber intermediate said vapor delivery inlet manifold and said vapor delivery outlet manifold adapted to having said conveyor move laterally therethrough and having said mixture flow across the chamber from said vapor delivery inlet manifold to said vapor delivery outlet manifold, and an exhaust outlet leading solely from said vapor delivery outlet manifold to the atmosphere.

2. The single pass vapor generation system described in claim 1, further comprising a drying air inlet and exhaust manifold adjacent the exit of said vapor delivery inlet manifold, a second blower, and a duct including a filter and a heater communicating between said blower and said drying air inlet manifold.

3. The single pass vapor generation system described in claim 1, wherein said vapor generation stack includes a vertical stack of heaters adjacent an opening into said duct, an inlet at the top thereof for receiving a 35% solution of hydrogen peroxide, an inlet air dispenser adjacent the top inlet, and a second duct communicating between said inlet air dispenser and said duct intermediate said opening and said duct heater.

4. The single pass vapor generation system described in claim 2, and a first iso-box mounted at the inlet to said vapor delivery inlet manifold, and a second iso-box mounted intermediate said vapor delivery inlet manifold and said drying air inlet manifold.

5. The single pass vapor generation system described in claim 2, wherein said containers are indexed through a plurality of stations past said vapor delivery inlet and drying air inlet.

6. The single pass vapor generation system described in claim 5, wherein the total number of stations is fourteen.

7. A single pass vapor generation sterilization system for containers, said system comprising a duct, a blower for blowing air into and through said duct, a flow of hydrogen peroxide sterilant, a duct heater for raising the temperature of said sterile air to a predetermined temperature, a vapor generation stack including at least one heater and a vaporizing nozzle and having an air dispenser operatively connected thereto, a vapor delivery inlet manifold, a vapor delivery outlet manifold, a chamber intermediate the vapor delivery inlet manifold and the vapor delivery outlet manifold adapted to having a conveyor move therethrough bearing said containers to be sterilized by said flow of said hydrogen peroxide sterilants, an exhaust outlet communicating solely from said vapor delivery outlet manifold to the atmosphere, and a drying air inlet manifold and a drying air exhaust manifold adjacent the exit end of said vapor delivery inlet and outlet manifolds, a chamber intermediate the drying air inlet manifold and the drying air exhaust manifold adapted to having said conveyor move therethrough to accommodate the removal of the condensed hydrogen peroxide and water solution from the containers, a second duct communicating between said drying air inlet manifold and a second blower, said second blower adapted to blowing air into and across said drying air inlet manifold, and a filter and duct heater operatively mounted in said duct for heating said air from said second blower for drying the containers as they exit from said chamber.

8. The sterilization system described in claim 7, and a first iso-box mounted at the entrance to said vapor delivery inlet manifold, and a second iso-box mounted intermediate said vapor delivery inlet manifold and said drying air inlet manifold.

9. The sterilization system described in claim 7, wherein said conveyor indexes a predetermined number of times while traversing through said chambers.

10. The sterilization system described in claim 9, wherein said number of indices is on the order of fourteen.

11. The sterilization system described in claim 7, wherein said hydrogen peroxide sterilant consists of a mixture of air, vaporized hydrogen peroxide, and vaporized water.

* * * * *